US006817799B1

(12) United States Patent
Petit

(10) Patent No.: US 6,817,799 B1
(45) Date of Patent: Nov. 16, 2004

(54) DUAL WALL STICK-SHAPED PRODUCT DISPENSER PACK

(75) Inventor: Robert Petit, Savigny-sur-Orge (FR)

(73) Assignee: Techpack International, Chevilly Larue (FR)

( * ) Notice: Subject to any disclaimer, the term of this patent is extended or adjusted under 35 U.S.C. 154(b) by 0 days.

(21) Appl. No.: 10/688,973

(22) Filed: Oct. 21, 2003

(30) Foreign Application Priority Data

Oct. 21, 2002 (FR) ..... 02 13043

(51) Int. Cl.[7] ..... B43K 21/08

(52) U.S. Cl. ..... 401/75; 401/68; 401/172; 401/175

(58) Field of Search ..... 401/68, 75, 171, 401/172, 174, 175, 213; 222/390

(56) References Cited

U.S. PATENT DOCUMENTS 4,915,528 A * 4/1990 Seager ..... 401/68
6,071,028 A * 6/2000 Klawson ..... 401/75
6,089,774 A * 7/2000 Franken et al. ..... 401/75
6,129,472 A * 10/2000 Thayer ..... 401/175
6,276,857 B1 * 8/2001 Szekely ..... 401/175

FOREIGN PATENT DOCUMENTS

FR 2703333 A * 10/1994 ..... A45D/40/04
FR 2707144 A * 1/1995 ..... A45D/40/04

* cited by examiner

*Primary Examiner*—Tuan Nguyen
(74) *Attorney, Agent, or Firm*—Young & Thompson

(57) ABSTRACT

A dispenser of a product includes a body forming a lateral wall in a moulded plastic material with, at its upper end, an upper orifice, and at its lower end, a bottom including a circular lower orifice. The lateral wall includes an assembly of an inner jacket including an inner tubular part, of area cross-section Si and thickness Ec, and an outer body including an outer tubular part of area cross-section Se>Si and thickness Ei, said thicknesses Ec and Ei being taken typically below 2 mm, so as to be able to manufacture the dispenser by high throughput moulding and without dimensional distortion of the inner jacket and of the outer body of plastic material, and in such a way that the outer body is able to have a cross-section different from that of the inner jacket.

39 Claims, 11 Drawing Sheets

3
2
1
8
6

3
R3=0,5
30
33
1

6
8,8
1
10
R3=0,3

A
10
A
3
22
2
20
1
8
7
42
21
5
E
D
B
B
4
C
C
6
E
D
24
23

10
30
31
3
2
6

12
71
7
2
8
80
70

DUAL WALL STICK-SHAPED PRODUCT DISPENSER PACK

The invention relates to the field of cosmetic product dispensers known as sticks, the cosmetic products so dispensed being typically paste-like, and most often deodorants.

PRIOR ART

Known stick type dispensers most often include:

- a body forming a skirt or a tubular lateral wall containing a cosmetic product propellant device as a solid or semi-solid stick, and open at its two ends, the cosmetic product having to show on the surface at the upper end in order to be applied, said tubular wall, open at its two ends, possibly including a bottom,
- a cap or top closing the upper end, typically in a leakproof way,
- a propellant device typically including two parts mobile one relative to the other, one being constituted by a piston in the form of a nut adjusted to the shape of the body, the piston, which supports the cosmetic product, being typically movable ax-ally but not in rotation, either because of the non-cylindrical shape of the body, or, if the body is cylindrical, by the engagement of at least one axial groove carried on the inner surface of the body and at least one groove formed on the periphery of the piston, the other typically including the following components, possibly in the form of a monobloc part:
- a base-plate anchored to the body in terms of axial movement, but free in rotation, the anchoring to the body being achieved typically by clipping or snapping-on,
- a threaded screw, integral with the base-plate, carrying and engaging with the piston forming a nut,
- a toothed wheel for driving the screw, which may possibly form all or part of the bottom, a toothed wheel which allows the user to move the stick shaped cosmetic product axially, and therefore to make it rise to the upper orifice of the body, as it is consumed.

In a known way, the piston and the base-plate have apertures which allow the dispenser to be filled through the bottom, the dispenser being closed by its typically leakproof cap.

In an equally well known way, the dispenser is formed by assembling, particularly by snapping on or clipping, the propellant device into the body, the other parts of the dispenser also being generally so assembled, reversibly in terms of the cap, and irreversibly in terms of the toothed wheel activating said screw.

Thus we may cite, by way of examples of patents describing dispensers, French patent application No. 00 04425, French patent No 2 573 734, of again European patent No 462 925.

PROBLEMS POSED

Prior art sticks include a body forming a relatively thick wall, manufacturing which poses problems of production rates and dimensional stability, particularly given the changes in viscosity resulting from the different colouring materials or pigments used to customise the sticks as a function of different customer requirements.

Furthermore, industrially manufactured prior art sticks are restricted to cross-sections or shapes that have relatively high radii of curvature, typically above 20 mm, which is to ensure they are leakproof: indeed, it is not possible to ensure the industrial production of parts moulded in plastic material intended to engage in a leakproof way when these parts have plane surfaces connecting with angles with a low radius of curvature, since leaks are still able to occur as a result of hollowing out or setting back in moulding. In fact, since said stick-form cosmetic product is typically soft and most often includes a volatile constituent, it is important for the dispenser to be leakproof, whether at the upper part of the dispenser between said cap and the body, or at the lower part of the dispenser between the body, the base-plate and the toothed wheel.

The main subject of the invention is a stick which is able to be manufactured at a high throughput while retaining the required dimensional stability. Another subject of the invention is constituted by sticks whose external cross-section or shape includes areas with a low radius of curvature, i.e. a radius of curvature typically below 30 mm, most often below 10 mm, or even lower than 1 mm.

DESCRIPTION OF THE INVENTION

According to the invention, the dispenser of a product, typically of a stick-form cosmetic product, includes a body forming a lateral wall of a moulded plastic material, delimiting a central cavity intended to contain said product, with, at its upper end, an upper orifice, and, at its lower end, typically a bottom including a circular lower orifice, a cap intended to seal said upper orifice, a propellant device including a base-plate and a piston, said base-plate, typically fitted with a channel or hollowed-out part, engaging with said lower orifice typically by a means of assembly that provides a rotation of said base-plate relative to said lateral wall or said bottom, said base-plate including a so-called "male" helical thread axial screw, said piston including a support for said product, typically open-work with a channel, and a central part with a so-called "female" thread engaging by screwing with said axial screw, a toothed wheel of external radius R engaging in rotation with said base-plate to rotate said axial screw, and a means of sealing said lower orifice and/or said channel, and is characterised in that said lateral wall includes an assembly:

a) of an inner jacket including an inner tubular part, of area cross-section Si and thickness Ec, forming at an upper end said upper orifice and including at a lower end said lower orifice, said inner jacket typically delimiting said central cavity, b) and an outer body including an outer tubular part of area cross-section Se>Si and thickness Ei, said thicknesses Ec and Ei being taken typically below 2 mm, so as to be able to manufacture said typically rigid dispenser using high throughput moulding and without dimensional distortion of said inner jacket and said outer body of plastic material, and in such a way that, since said inner tubular part is part of or is included in said outer tubular part and cannot therefore be seen from the side, said outer body is able to have a cross-section different from that of said inner jacket, with in particular different radii of curvature for said outer body and for said inner jacket.

As the applicant has pointed cut, the dispenser according to the invention resolves the essential problem which is to be able to manufacture with a high throughput dispensers that are free from manufacturing defects arising particularly from distortions, deformations or warping in the walls of dispensers made of thermoplastic materials.

The invention applies to all types of dispenser, including cylindrical dispensers.

Furthermore, by using an inner jacket and an outer body to form the lateral wall of the body of the dispenser, it is possible to obtain dispensers with shapes that have been inaccessible until now and to resolute simultaneously the problem of production rates, that of dimensional stability, as well as that of the radii of curvature, without increasing the material cost of said dispenser, and while retaining the degree of leaktightness required for said dispenser.

Thus, the invention offers an original design for dispensers wherein, in the main, an inner jacket provides the majority of the technical functions, particularly in relation to leaktightness, whereas the outer body provides the majority of the functions of decoration or external appearance while keeping said inner jacket largely out of sight.

DESCRIPTION OF THE FIGURES

All the figures relate to the invention.

FIGS. 1*a* to 3*e*, 5*a* to 8*b* relate to the same form of dispenser (1).

FIG. 1 is a perspective view of the closed dispenser (1), the cap (3) being snapped shut on the body (2).

FIG. 1*b* is a view from above of the closed dispenser (1) or of the cap (3).

FIG. 1*c* is a view from below of the dispenser (1).

FIG. 1*d* is an axial cross-section, along the axis (10) of the dispenser (1), and the line F—F in FIG. 2*a*.

FIG. 1*e* is an axial cross-section, along the axis (10) of the dispenser (1), and the line G—G in FIG. 2*a*.

FIG. 1*f* is a cross-section, parallel to an axial cross-section, along the line E—E in FIG. 1*d* of the body (2) of the dispenser (1).

FIGS. 3*a* to 3*e* relate to a dispenser (1) loaded with a cosmetic product (11) and open, said cap (3) being separated from said body (2).

FIG. 3*a* shows a side view of the body (2), said body (2) being orientated according to FIG. 1*d*.

FIG. 3*b* is a side view of the body (2), said body (2) being orientated according to FIG. 1*e*.

FIG. 3*c* is a view from below of said cap (3).

FIG. 3*d* is a perspective view from below of said cap (3).

FIG. 3*e* is a perspective view of said body (2).

FIGS. 5*a* to 7*b* are enlarged cross-section views of parts of the body (2) of the dispenser (1).

Figure 5A:
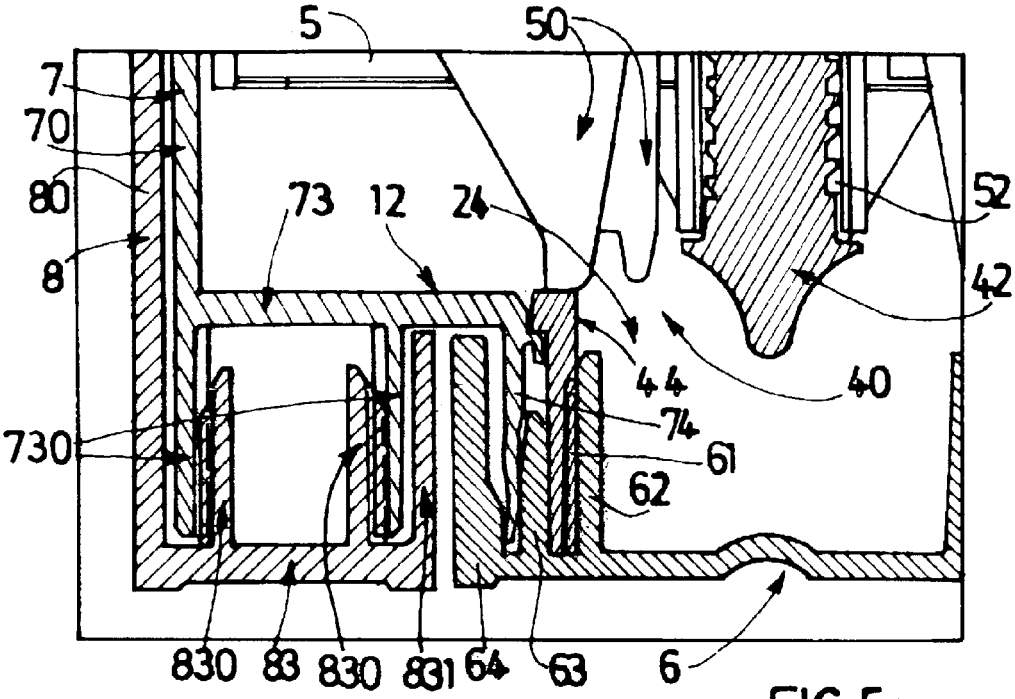
Figure 5B:
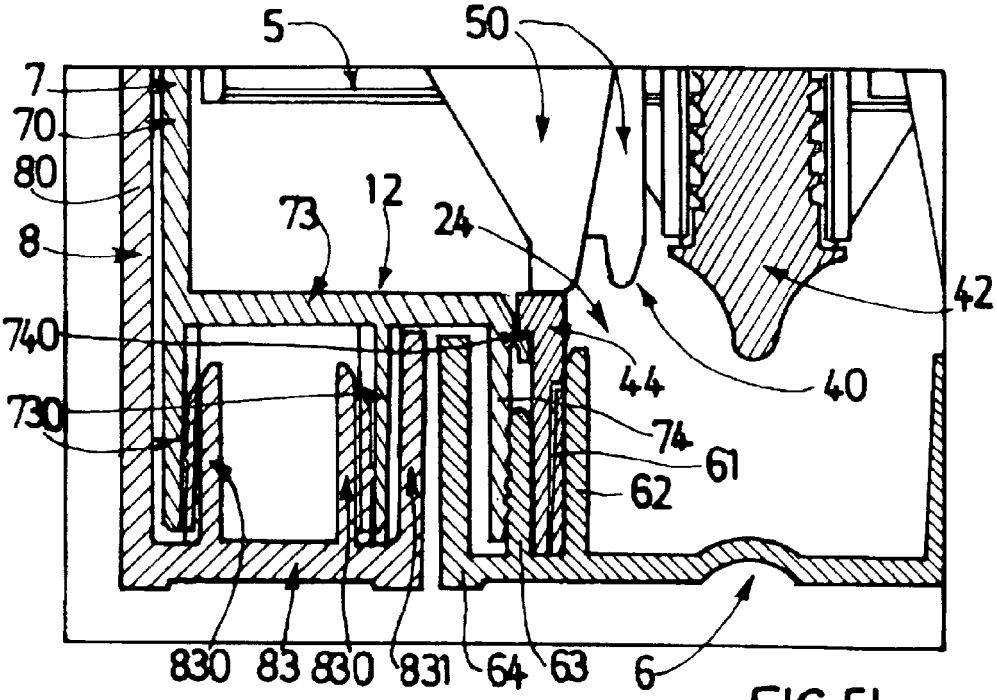
Figure 6A:
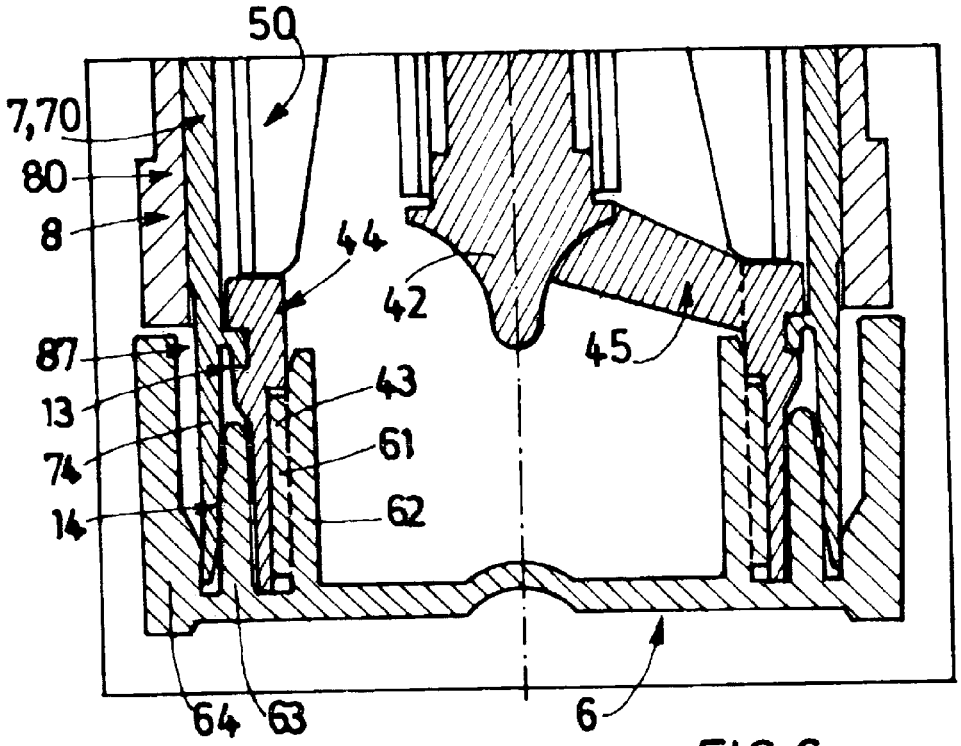
Figure 6B:
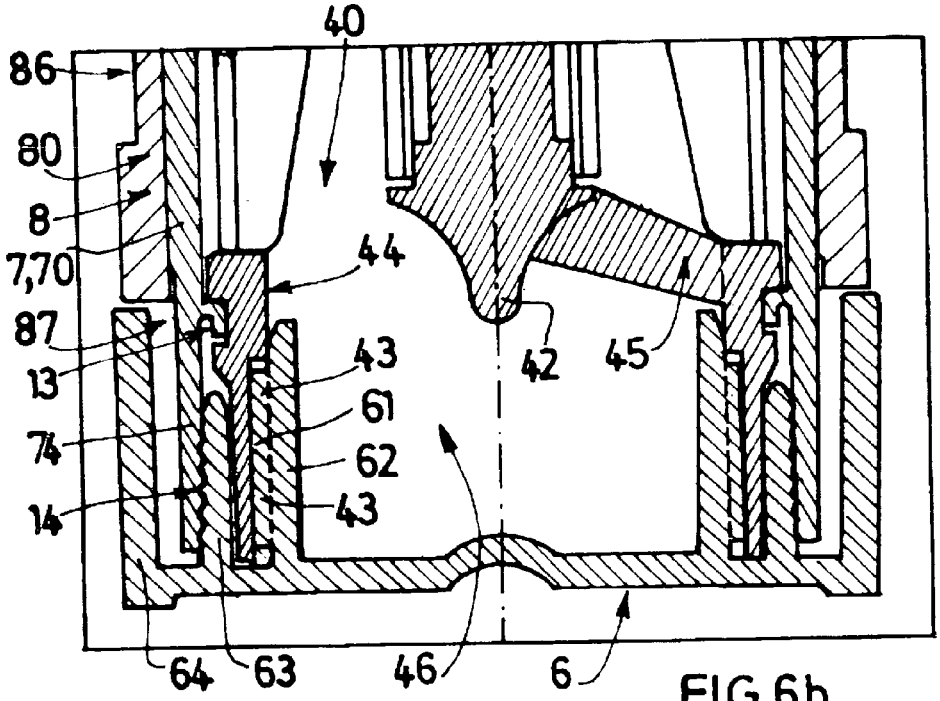

The views 5*a* to 7*a* relate to the engagement between said base-plate (4), said toothed wheel (6), said inner jacket (7) and said outer body (8) according to a first variant in FIGS. 5*a* and 6*a*, and according to a second variant in FIGS. 5*b* and 6*b*.

Figures 1A, 1B, 1C, 1D, 1E, 1F:
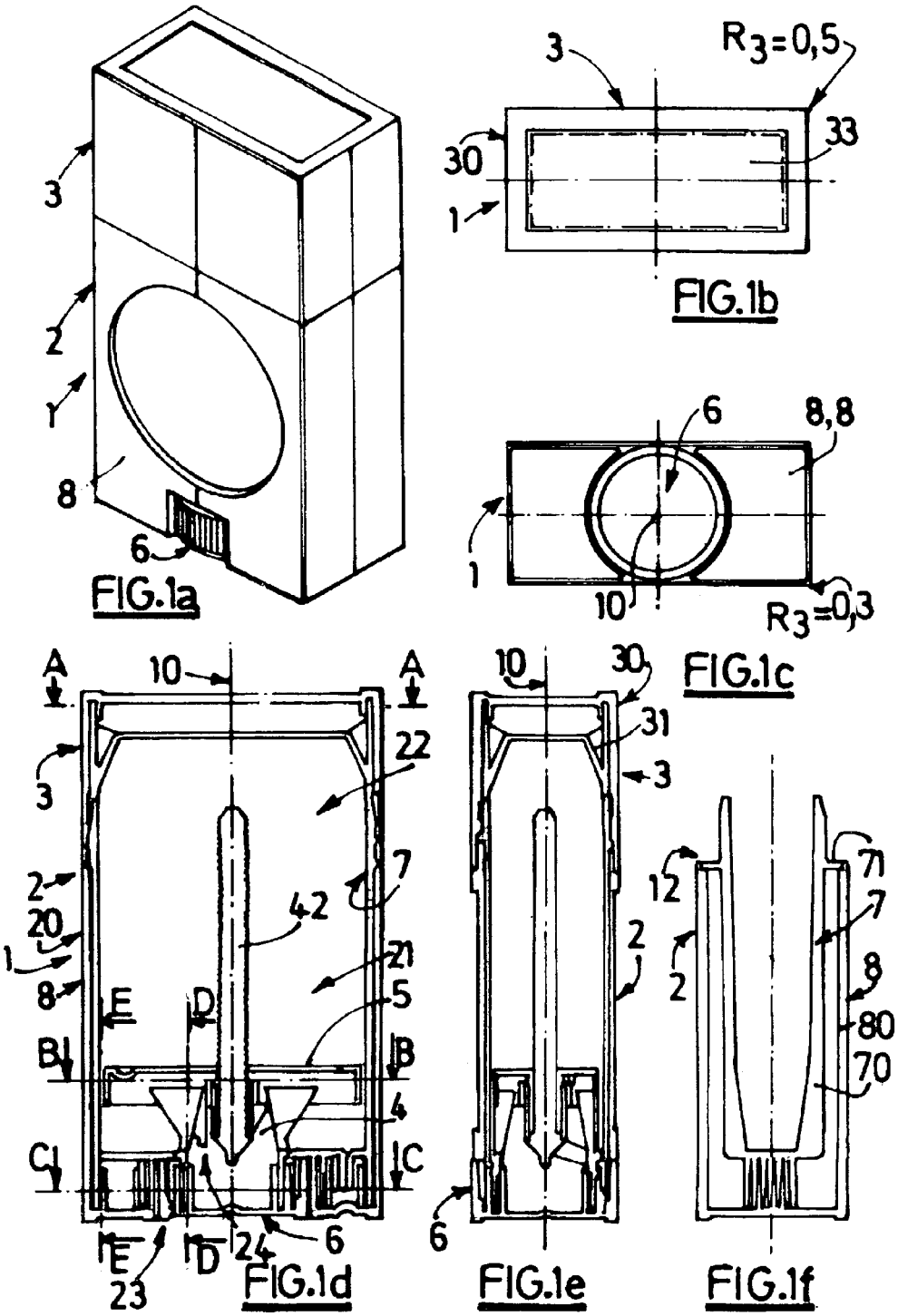

FIGS. 5*a* and 6*a* are partial views in axial cross-section according to FIG. 1*d*, whereas FIGS. 5*b* and 6*b* are partial views in axial cross-sect-on according to FIG. 1*e*.

Figure 2A:
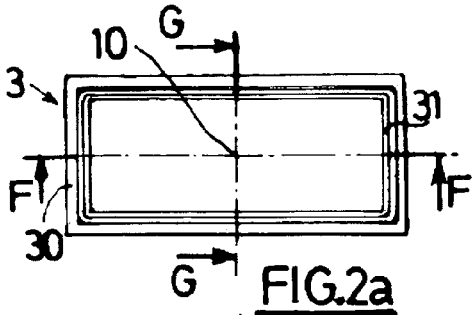
FIG. 2*a* is a transverse cross-section along the line A—A in FIG. 1*d*.
Figure 2B:
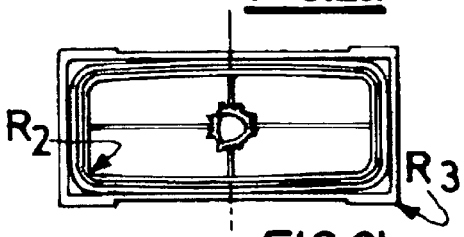
FIG. 2*b* is a transverse cross-section along the line B—B in FIG. 1*d*.
Figure 2C:
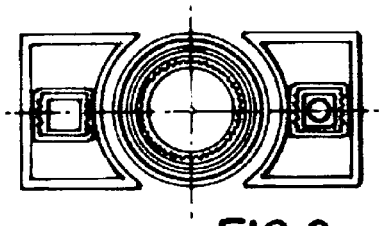
FIG. 2*c* is a transverse cross-section along the line C—C in FIG. 1*d*.
Figure 2F:
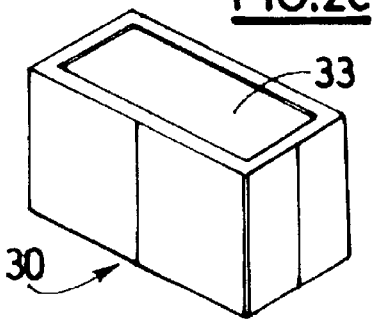
FIG. 2*f* is a perspective view of said outer shell (30) of said cap (3).
Figure 2G:
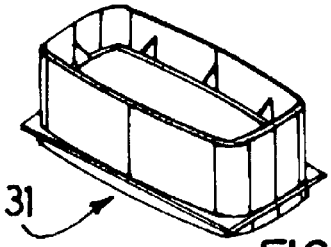
FIG. 2*g* is a perspective view of said inner leakproof lining (31) of said cap (3).
Figure 2D:
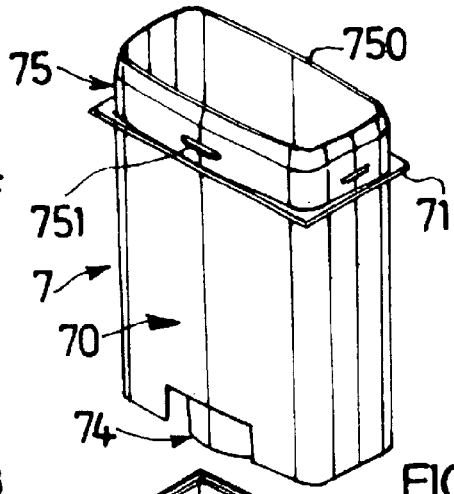
FIG. 2*d* is a perspective view of said inner jacket (7).
Figure 2E:
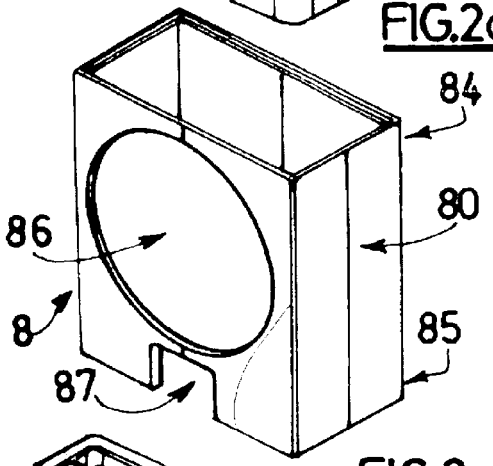
FIG. 2*e* is a perspective view of said outer body (8).
Figure 2H:
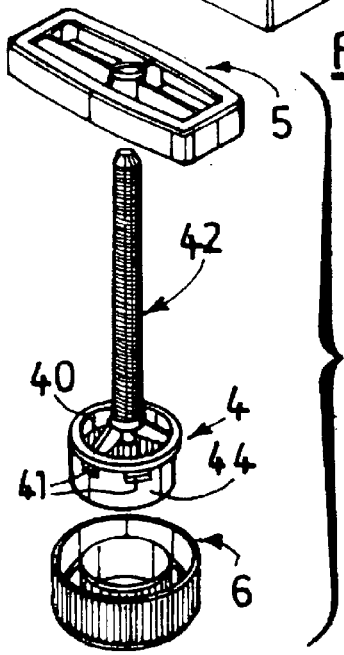
FIG. 2*h* is a perspective view of the different parts forming said propellant device: said toothed wheel (6) engaging in rotation with said base-plate (4), said base-plate (4) forming a monobloc part with said axial screw (42) and including (snap-on) means for assembly (41) with said inner jacket (7), and said piston (5) engaging with said axial screw 142).
Figure 3A:
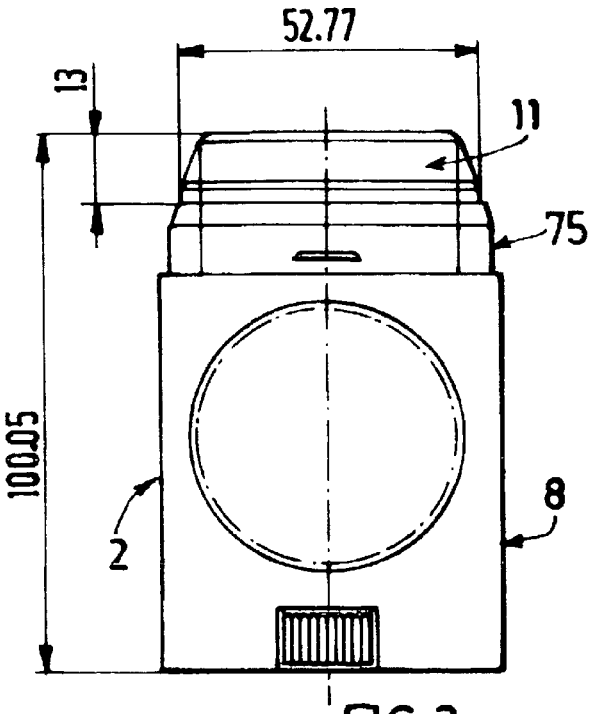
Figure 3B:
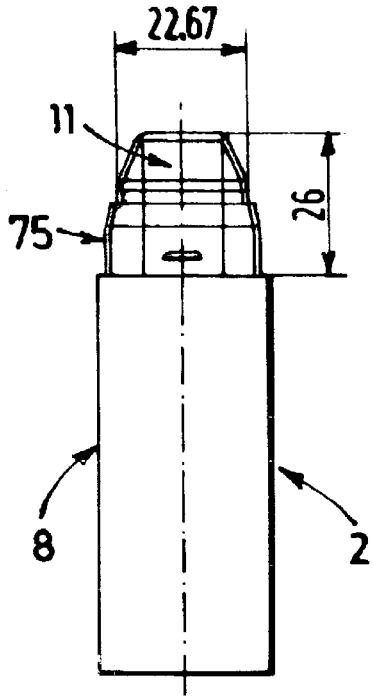
Figure 3C:
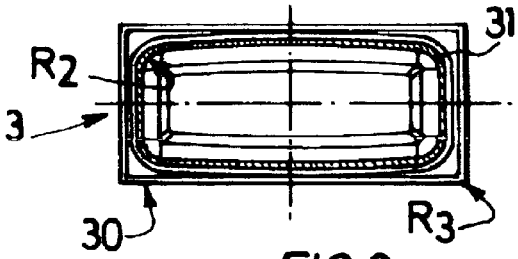
Figure 3D:
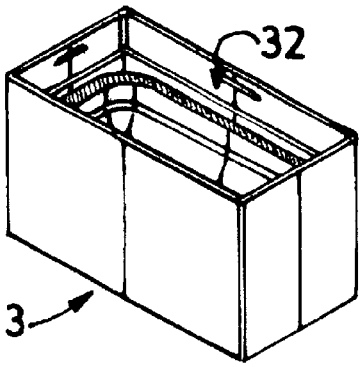
Figure 3E:
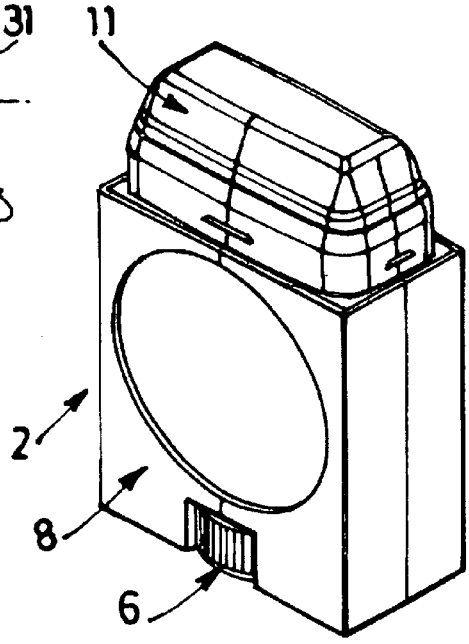
Figure 7A:
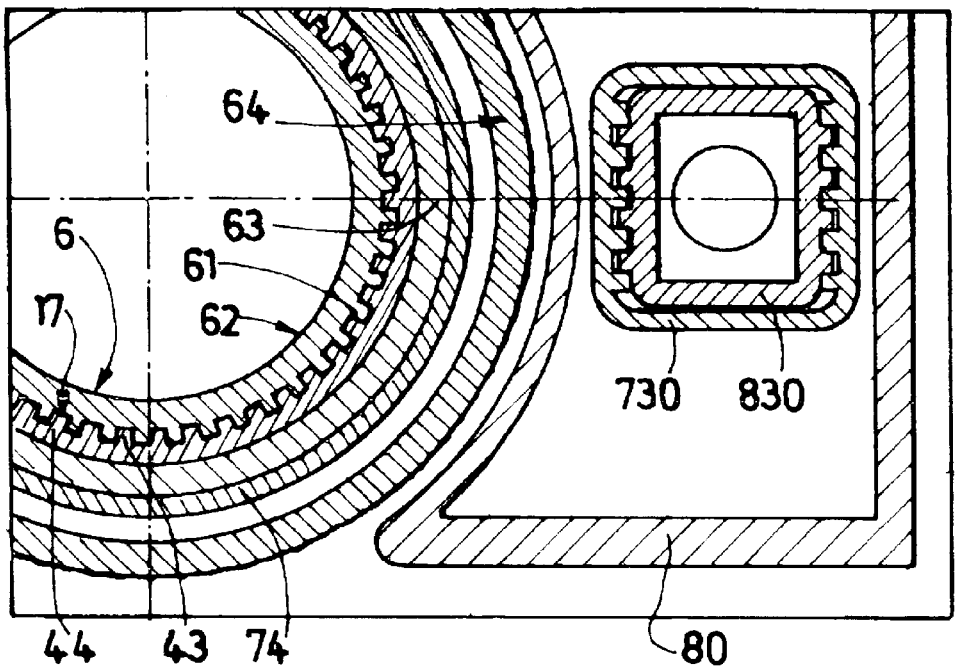

FIG. 7*a* is a partial view in transverse cross-section according to FIG. 2*c*, which shows a succession of concentric walls marked symbolically by the succession of corresponding reference numbers, from inside to outside: 62/44/63/74/64.

Figure 7B:
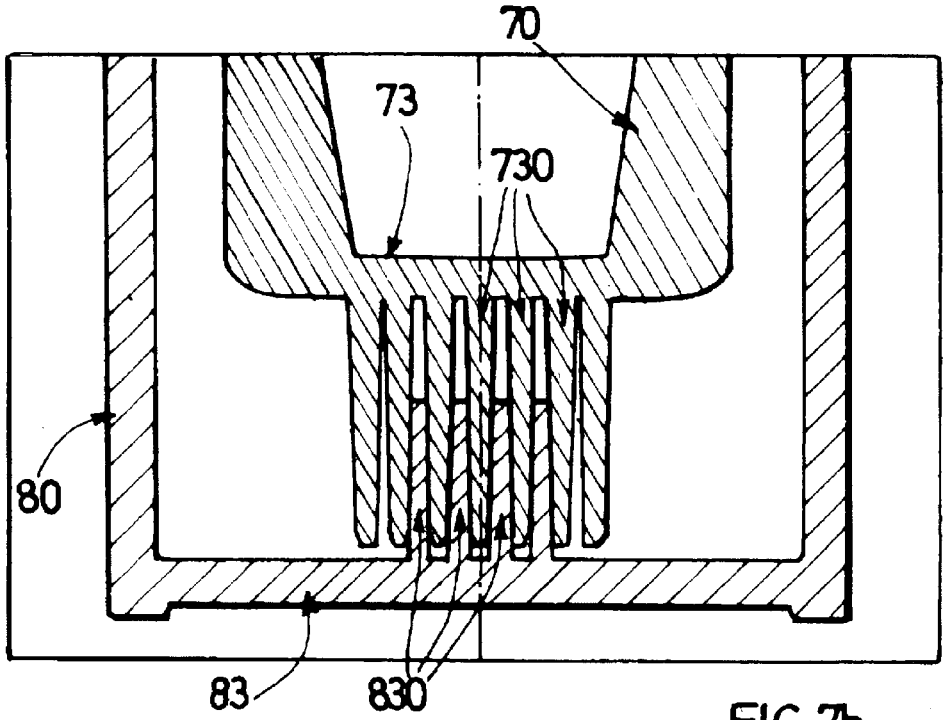

FIG. 7*b* is a partial view in cross-section parallel to the axis (10) in figure 1*f*.

Figure 8A:
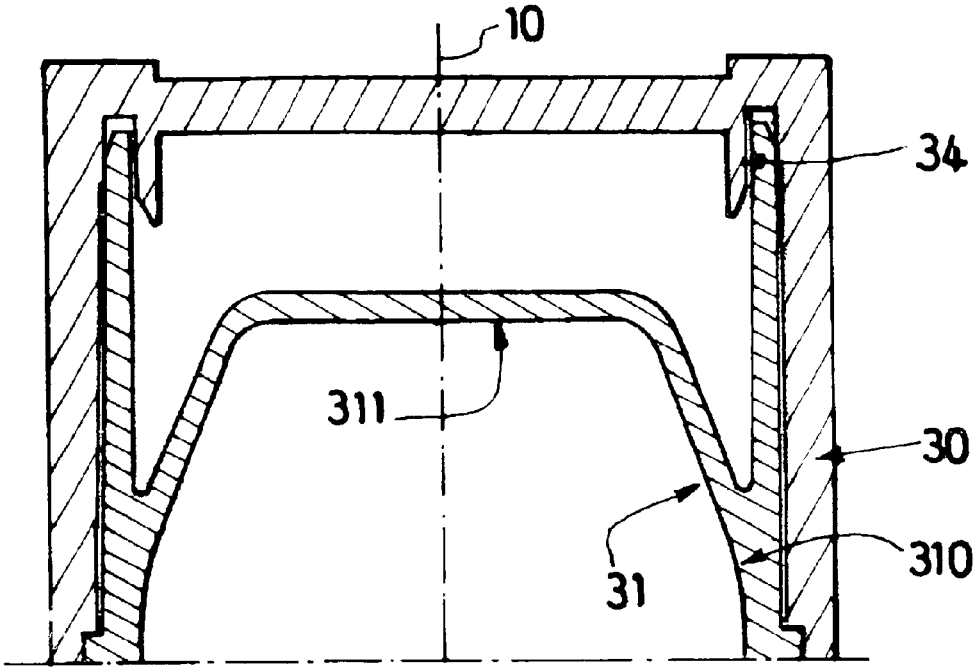
Figure 8B:
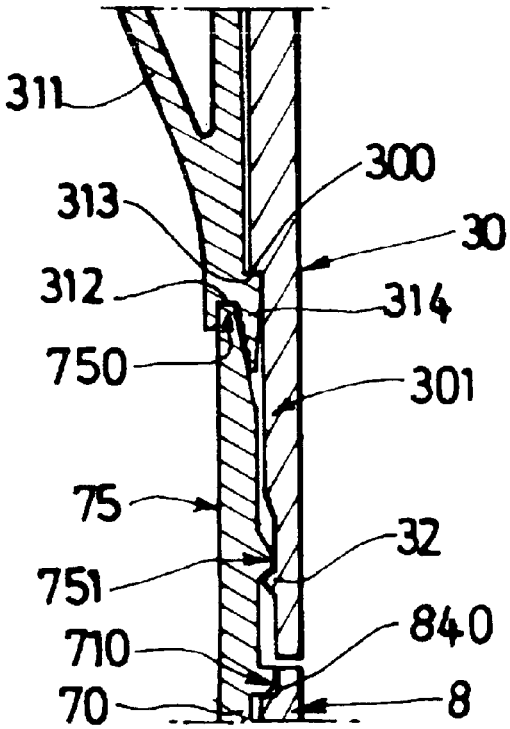

FIGS. 8*a* and 8*b* are partial axial cross-sections of the cap (3) and at its engagement with the inner jacket (7) and the outer body (8) forming said body (2).

FIG. 8*a* corresponds to the, upper part of the cap (3), whereas FIG. 8*b* shows the means that make it possible to obtain a leakproof seal between said inner lining (31) and said inner jacket (7), and the way the outer shell (30) snaps onto said body (2), and in particular onto said inner jacket (7).

Figure 9A:
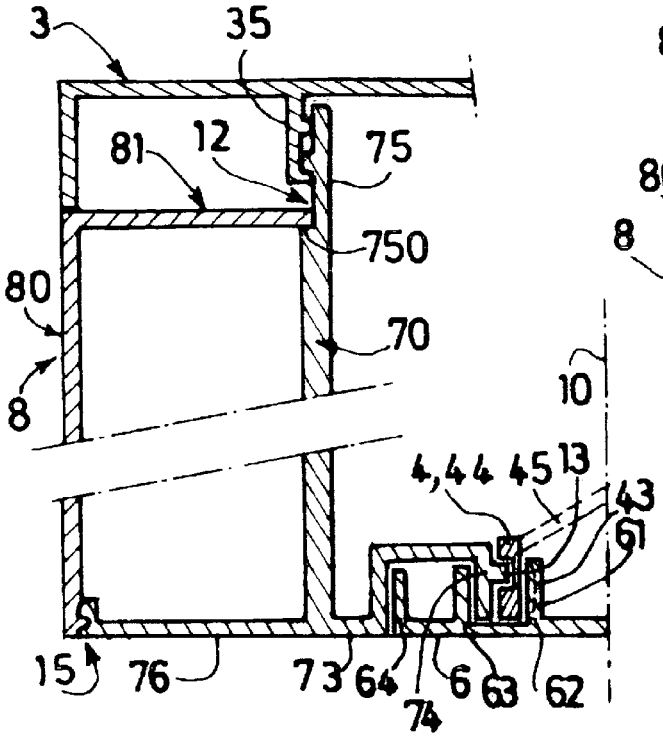
Figure 9B:
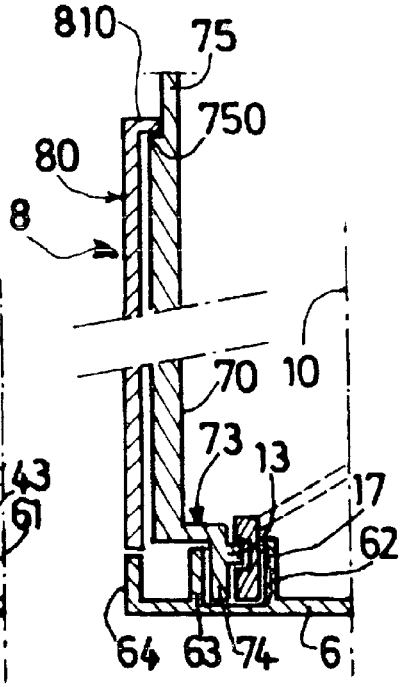
Figure 9C:
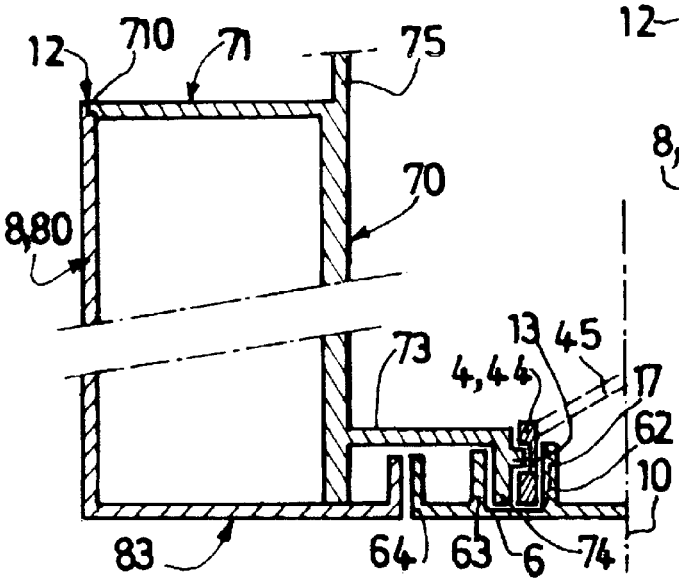
Figure 9D:
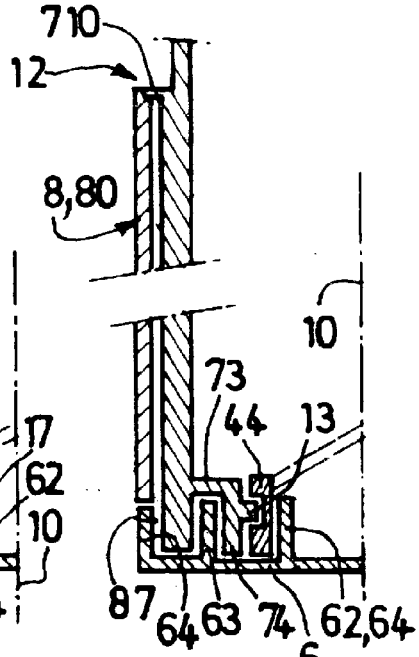
Figure 10:
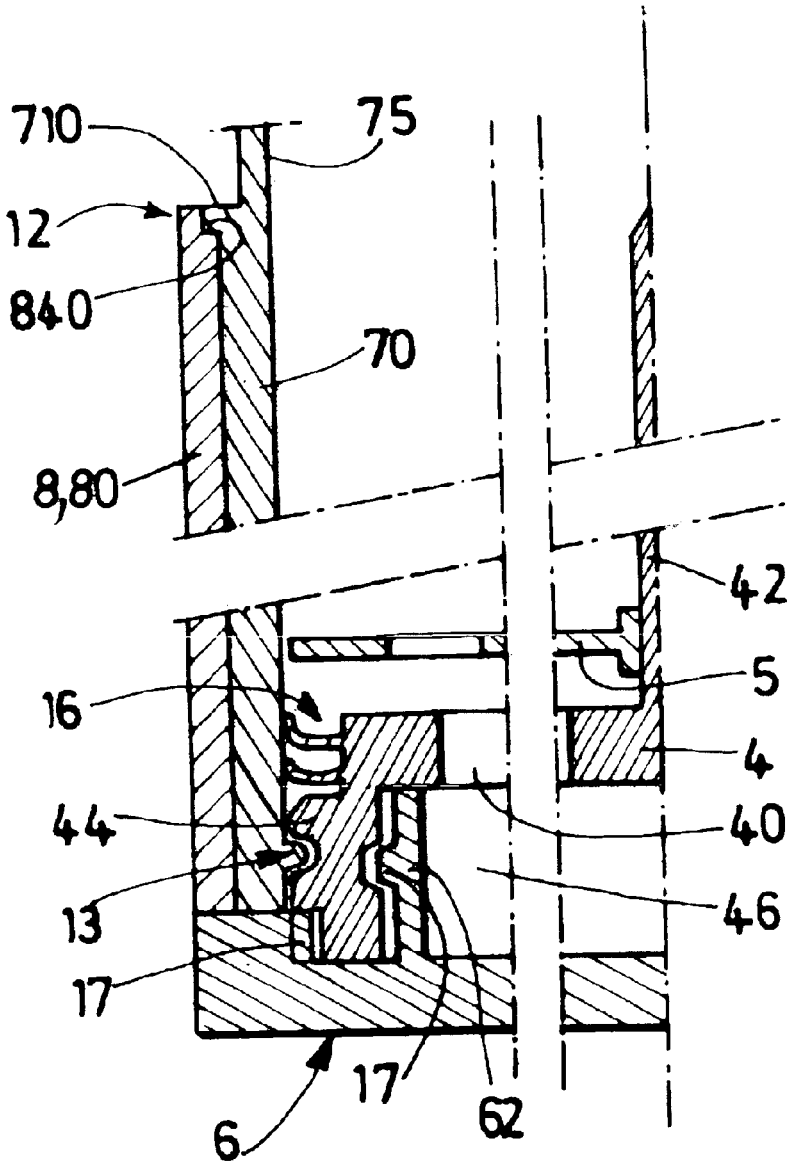

FIGS. 9*a* to 10 are partial axial cross-sections showing other forms of the invention.

FIGS. 9*a* and 9*c* are partial axial cross-sections according to FIG. 1*d*, whereas FIGS. 9*b* and 9*d* are partial axial cross-sections according to FIG. 1*e*.

Among these FIGS. 9*a* to 9*d*, only FIG. 9*a* includes a cap portion (3) equipped with an inner skirt (35) snapped in a leakproof way onto said upper skirt (75) of the inner jacket (7).

In the form of dispenser (1) according to FIGS. 9*a* and 9*b*, said outer body (8) forms the roof (81), whereas the inner jacket (7) forms the bottom (73). The outer body (8) is snapped onto the inner jacket (7) by snap-on means (15), the base-plate (4) being anchored to the vertical wall (74) of the inner jacket (7), and the toothed wheel (6) being anchored to said base-plate. The bottom is made leakproof particularly by the engagement between the central skirt (63) of the toothed wheel (6) and the vertical wall (74) of the inner jacket (7).

In the form of dispenser (1) according to FIGS. 9*c* and 9*d*, said inner jacket (7) forms the roof (71), whereas said outer body (8) forms the bottom (83). In this form said outer body is locked axially between the radial protection (710) of said jacket, at its upper end, and the outer skirt (64) of the toothed wheel (6), at its lower end, by means of its channelled-out part (87), the engagement of the other components of the dispenser being similar to that shown in FIGS. 9*a* and 9*b*.

FIG. 10 corresponds to a form of cylindrical dispenser (1) wherein, as in FIG. 9*d*, the outer body (8) is locked axially between the radial projection (710) of said jacket (7) and the toothed wheel (6). The base-plate (4) is anchored to the inner jacket (7) by a snap-on means (13) and by leakproof seal means (16) in the form of leakproof tabs, the toothed wheel (6) being anchored to the base-plate (4) by a means of engagement that includes axially snapping onto and meshing with milled or notched surfaces.

Figure 11A:
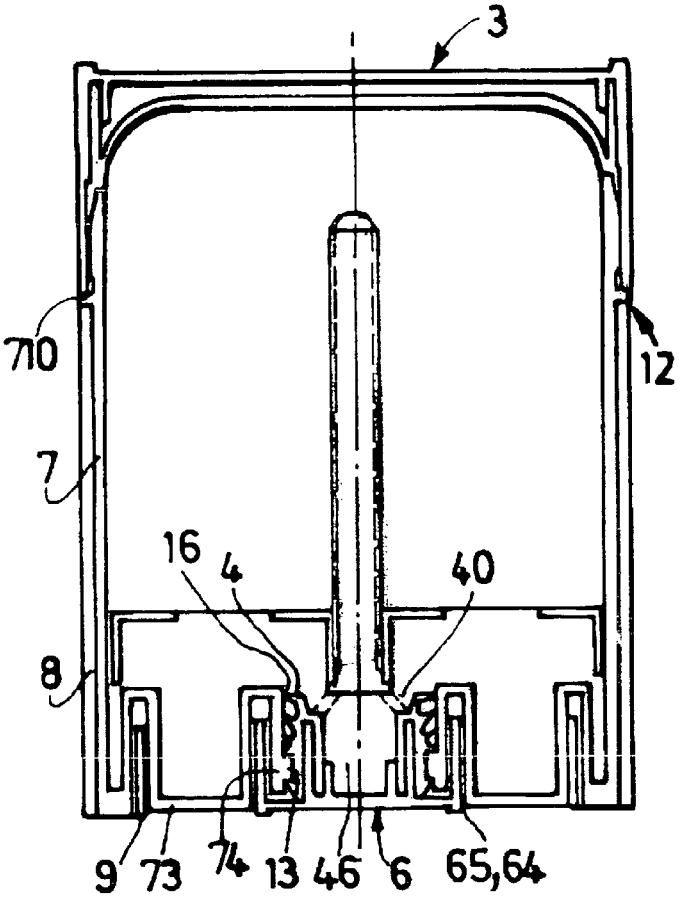
Figure 11B:
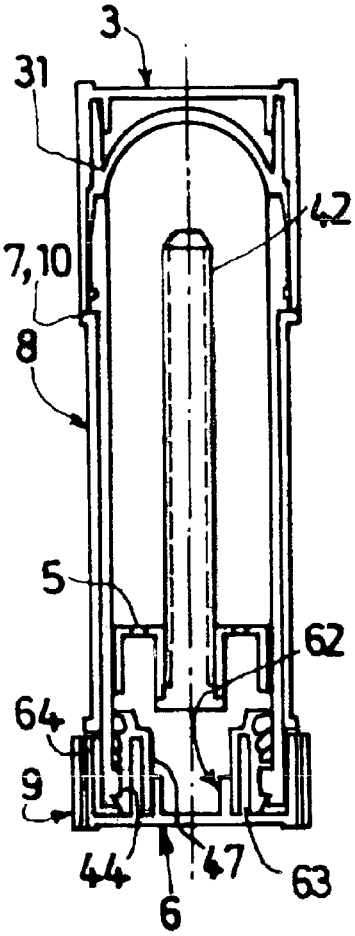
Figure 11C:
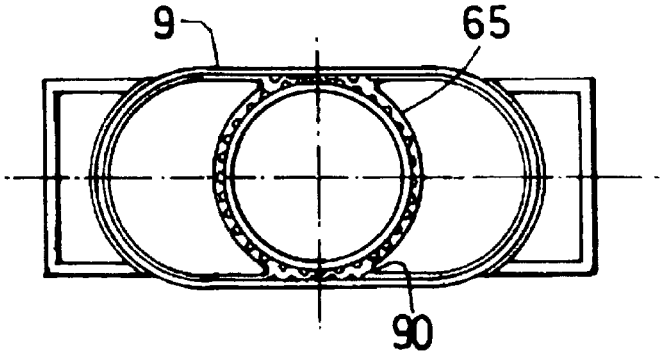

FIGS. 11*a* to 11*c* correspond to another form of the invention, FIGS. 11*a*, 11*b* and 11*c* being similar to FIGS. 1*d*, 1*e* and 1*c* respectively.

As shown in FIGS. 9*d* and 10, the outer body (8) is locked axially between the radial projection (710) of said jacket (7) and the outer skirt (64) of the toothed wheel (6). Said base-plate (4) includes two coaxial cylindrical walls (44) and (47), such that the succession of walls, from inside to outside, may be symbolised by the succession of reference numbers: 62/47/63/44/74/65. The assembly and leakproof seal between said jacket (7) and said base-plate (4) is similar to that shown in FIG. 10.

DETAILED DESCRIPTION CF THE INVENTION

According to the invention, said base-plate (4) is able to seal said lower orifice (24), to be fitted with at least one hollowed out-part or channel (40), and typically to form a cavity (46); said toothed wheel (6) is able to form a typically leakproof plug for said hollowed-out part or channel (40) or said cavity (46), so as to form said sealing means and to allow said dispenser (1) to be filled through the bottom.

These are forms present in the dispensers shown in the appended figures.

However, the invention is in no way restricted to dispensers that can be filled through the bottom. Indeed, it may apply to any type of dispenser, even to dispensers able or requiring to be filled through the top, insofar as any distributor may a priori include a body able to be manufactured by assembling an inner jacket and an outer body according to the invention.

Typically, said inner jacket (7) and said outer body (8) may include radial and axial engagement means (12, 15), in such a way that they form a rigid body after a typically axial assembly of said inner jacket into said outer body.

Figure 4A:
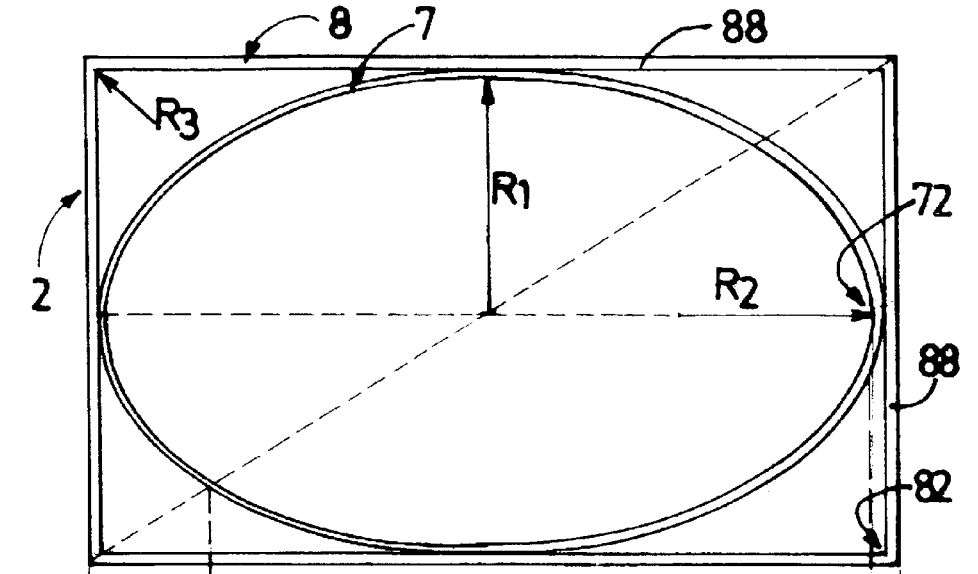
FIGS. 4*a* and 4*d* a–e transverse cross-section views showing the engagement between an outer body (8) of rectangular cross-section and an oval inner jacket (7), the toothed wheel (6) having been added to the diagram FIG. 4*d*, these figures showing the different radii of curvature relative to the invention: the radii R3—very small—relate to the connection of the surfaces of the outer body (8); the radii R1 and R2 >>R3 relate to the inner jacket (7); the radius R is that of the toothed wheel (6).
Figure 4B:
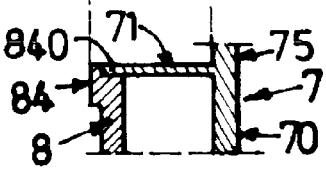
Figure 4C:
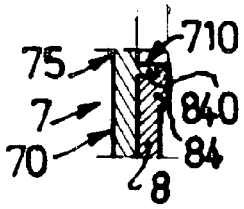
Figure 4D:
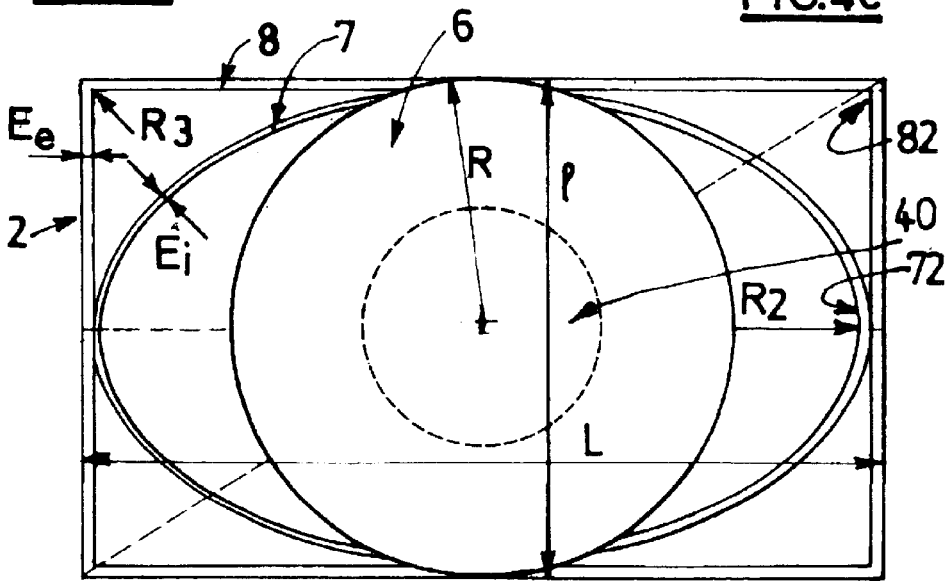

However, it is possible according to the invention to obtain said radial and axial engagement by simply fitting said inner jacket (7) into said outer body (8) taking into account the possibility of having tangent surfaces, as shown diagrammatically in FIGS. 4*a* and 4*d*.

According to the invention, said thickness Ei may be from 0.3.E to 0.7.E and said thickness Ei may run from 0.3.E to 0.7.E.

Furthermore, the applicant has noted that the invention enabled the overall thickness of the body (2) of the dispenser (1) to be reduced. Indeed, the combined wall thickness E=Ei+Ee may be at least 5 to 10% less than the thickness E' of a prior art dispenser—for identical materials in both cases, hence a corresponding material gain.

We may speculate that this material gain is the result of the "composite" structure of the body (2) according to the invention, since this "composite" structure which uses two components instead of one as in the prior art is able to lead to improved mechanical strength, and therefore to a possibility of material gain at identical mechanical strength.

As shown typically in FIGS. 4*a* and 4*d*, but also in FIGS. 1*a* to 3*e*, said inner jacket (7) may include areas (72) with a high radius of curvature Ri typically above 30 mm, said outer body (8) including areas (82) with a radius of curvature Re below Ri. According to the invention, said inner jacket (7) engages with said cap (3) to provide the required seal.

This is a very advantageous and very important form of the invention since it allows the shape and the function of the outer body (8) and of the inner jacket (7) to be dissociated. It therefore opens the way to a whole range of dispensers totally new in appearance and unimaginable with the dispensers of the prior art, with ridges with a very low radius of curvature, with plane surface sides, with partially channelled plane surfaces, as appears by way of example in FIG. 1*a*. Thus, as shown in the FIGS. 1*a* to 3*e*, said outer body (8) may include typically plane surfaces (88), said surfaces, typically internally tangent to said inner jacket (7), being connected via said areas with a radius of curvature Re (82, typically less than 1 mm, with even radii of curvature as small as 0.4 mm as shown in the figures and embodiment examples, which produces a radical change in the shape and external appearance of said dispenser, which can thus be typically parallelepiped.

It should be noted that prior art dispensers were only able to include bodies and caps with large radii of curvature—typically at lease equal to 30 mm, without which they would fail to be leakproof between said body and said cap.

According to a variant of the invention shown in FIGS. 1*f*, 9*c*, 9*d*, 10, 11*a* and 11*b*, said inner jacket (7) may include an outer roof (71) engaging with said outer tubular part (80) of said outer body (8), to form said radial and/or axial engagement means (12), said inner roof (71) typically having an area corresponding to a cross-section difference ΔS=Se—Si for said upper end.

According to another variant of the invention shown in FIGS. 9*a* and 9*b*, said outer body (8) may include an inner roof (81) or a radial projection (810) engaging with said inner tubular part (70) of said inner jacket (7), to form said radial and/or axial engagement means (12), said inner roof (81) typically having an area corresponding to a cross-section difference ΔS=Se-Si for said upper end.

According to another variant of the invention shown in FIGS. 1*c*, 5*a*, 7*b* and 9*c*, said bottom (23% of said body (2) may be formed or may include externally a bottom (83) integral with said outer tubular part (80), said bottom (83) engaging typically with said inner jacket (7) to form said axial and/or radial engagement means (12).

According to another variant of the invention shown in FIGS. 9*a* and 11*a*, said bottom (23) may be formed by or may include an outer bottom (76) integral wish said inner tubular part (70), said bottom (76) typically engaging with said outer body (8) to form said axial and/or radial engagement means.

As illustrated with the dispenser shown in FIGS. 1*a* to 3*e* and 5*a* to 8*b*, and in FIGS. 9*c* and 9*d*, said dispenser (1) may include said outer roof (71) and/or said radial projection (710) and said bottom (83).

As shown in FIGS. 9*a* and 9*b*, said dispenser (1) may include an inner roof (81) and/or said radial projection (810) and an outer bottom (76).

Furthermore, as shown in FIGS. 11*a* and 11*b*, said dispenser (1) may include said outer roof (71) and/or said radial projection (710) and said bottom (73).

According to the invention, said outer tubular part (80) of said outer body (8) may engage at its upper part (84) with said outer roof (71) or with a radial projection (710), so as to form an upper radial and/or axial stop, typically by means of a peripheral channel (840). See FIGS. 1*d* to 1*f*, 8*b*, 9*c*, 9*d*, 10, 11*a* and 11*b*.

According to the invention, said tubular part (70) of said inner jacket (7) may engage at its upper part with said inner roof (81) or with a radial projection (810), so as to form an upper radial and/or axial stop, typically by means of an upper edge (750). See FIGS. 9*a* and 9*b*.

Whatever the form of the invention, said body 2) at its upper end includes an engagement between said inner jacket (7) and said outer body (8). This engagement includes at least one radial lock, such that said inner jacket (7) has no degree of freedom relative to said outer body (8) in the radial direction, in other words in a direction perpendicular to said vertical axis (10) of the dispenser (1). This engagement may further generally include an axial stop, one of the two parts (7) and (8) of said body (2) including or forming an axial stop for the other, as shown in the figures. All these means of radial and/or axial engagement bear the identifier (12).

The engagement between the two parts (7) and (8) of said body (2) extends typically to the lower part of said body (2).

Thus, as shown in FIGS. 5*a* to 7*b*, said bottom (83) may include vertical projections (830), typically milled, formed on its upper surface, engaging, typically by fitting or snapping-on axially, with said bottom (73) by means of vertical projections (730) formed on its inner surface.

Said vertical projections (730) may form an outer milled square engaging with an inner milled square formed by said vertical projections (830). See FIG. 7*a*.

Likewise, as shown in FIG. 9*a*, said outer bottom (76) ray engage with said outer tubular part (80), at its lower part, by snapping on so as to form said snap-on means (15).

Typically, as shown in FIGS. 6*a*, 6*b*, 9*b*, 9*d*, 10, 11*b*, said toothed wheel (6) may have a diameter equal to 2.R at least equal to the width 1 or smaller dimension of the cross-section of said outer tubular part (80), in such a way that said toothed wheel (6) forms an axial stop for said outer tubular part (83).

According to the invention, and as shown diagrammatically in FIGS. 4*a* and 4*d*, said inner (70) and outer (83) tubular parts may be tangent, said area cross-section Si falling within said area cross-section Se, in such a way that said inner tubular part (70) has no degree of freedom in the radial direction relative to said outer tubular part (80).

As shown in FIGS. 1*d*, 5*a* to 6*b*, 7*a*, 9*a* to 11*b*, said base-plate (4) may be fitted to said inner jacket (7), by means either of said inner tubular part 170), or of said bottom (73), or of a vertical wall (74) integral with said bottom (73) or with said inner tubular part (70), typically by snapping-on axially (13) or engagement of male and female components or fitting, said base-plate (4) being typically fitted to said lateral jacket (70) or to said bottom (73) or to said vertical wall (74), typically by inserting said base-plate (4) and said associated piston (5) into said inner jacket (7) through said upper orifice (22).

However, in the event of said inner jacket (7) not including a bottom (73), as shown in FIG. 10, it might then be possible to insert said base-plate (4) and its piston (5) through said lower orifice.

Said base-plate (4), which is a part able to rotate on itself along the axis (10) of the dispenser relative to said inner jacket (7), may include a typically cylindrical wall (44, 47) engaging in rotation with said toothed wheel (6) or with a skirt (62, 63, 64) of said toothed wheel, typically by snapping on or fitting in such a way as to form a radial and axial engagement means (17).

As shown in FIGS. 5*a* to 7*a*, 9*a* to 11*b*, the axial engagement between said toothed wheel (6) and said base-plate (4) may be formed by snapping on or fitting two typically cylindrical milled coaxial surfaces (61) and (13), which can enmesh, or possibly by firmly fitting said toothed wheel (6) or said skirt (62, 63, 64) into said base-plate (4) or into said cylindrical wall (44, 47).

Given the number of surfaces in contact—see for example FIGS. 6*a* and 6*b*, a fitting by means of said toothed wheel, after filling said dispenser, may be in many cases suffice to provide an engagement of said toothed wheel (6) and of said base-plate (4) which is both axial and in rotation.

It is important to note that, according to the invention, said toothed wheel, typically by means of said central skirt (63), may engage in a leakproof way with said inner tubular part (70), or with said bottom (73), or with said vertical wall (74), to form said leakproof seal means (14) in a way so as to render optional, or possibly to eliminate, the leakproof seal between said base-plate (4) and said inner jacket (70), or said bottom (73) or said vertical wall (74).

This advantageous form has been shown in accordance with two variants in FIGS. 5*a* to 6*b*. According to a first variant shown in FIGS. 5*a* and 6*a*, it may be seen that the vertical wall (74) engages in a leakproof way with the central (63) and outer (64) skirts of said toothed wheel 16), said vertical wall (74) including a thinned out and flexible lower part typically forming two leakproof contact areas, one with sago central skirt (63), the other with said outer skirt (64).

According to a second form shown in FIGS. 5*b* and 6*b*, said vertical wall (74, only engages in a leakproof way with said central skirt (63), typically by annular parts forming at least two leakproof contacts of the cone/plane type.

However, as shown for example in FIG. 10, said toothed wheel (6) may engage in a leakproof way with said base-plate (4), and possibly with said inner tubular part (70), or with said bottom (73), or with said vertical wall (74), said base-plate possibly engaging in a leakproof way with said inner tubular part (70), or with said bottom (73), or with said vertical wall (74).

Most often, and as shown in all the dispensers shown in figures, except for the one in FIG. 10, said toothed wheel (6) may include three concentric skirts: an inner skirt (62) typically bearing said milled surface (43), a central skirt (63) typically engaging in a leakproof way with said vertical wall (74), an outer skirt (04) forming a manual rotation button.

Typically, the engagement of said toothed wheel (6) with said base-plate, said base-plate engaging with said inner jacket (7), may form a succession of concentric walls which engage, a succession denoted from inside to outside "62/44/63/74/64", the walls (62) and (43) ensuring the engagement in rotation of said toothed wheel and of said piston, the walls (63) and (74) providing the leakproof seal between said toothed wheel (6) and said inner jacket (7), the walls (62) and (74) typically exerting a radial compression on the intermediate walls (44) and (63). See FIGS. 5*a* to 6*b*.

However, the engagement of said toothed wheel (6) with said base-plate, said base-plate engaging with said inner jacket (7), may form a succession or concentric walls which engage, denoted from inside to outside "62/44/74/63/64", the walls (62) and (43) ensuring the engagement in rotation of said toothed wheel and of said piston, the walls (63) and (74) providing the leakproof seal between said toothed wheel and said inner jacket, the walls (62) and (64) typically exerting a radial compression on the intermediate walls (44) and (74). See FIGS. 9*a* to 9*d*.

Furthermore, as shown in FIGS. 11*a* to 11*b*, said base-plate (4) ray include two cylindrical walls (44) and (47), and the engagement of said toothed wheel (6) with said base-plate, said base-plate engaging with said inner jacket (7)

may form a succession of concentric walls which engage, denoted from inside to outside "62/47/63/44/74/64", the walls (62) and (47) typically ensuring the engagement in rotation of said toothed wheel and said piston, the leakproof seal being typically provided between said base-plate (4) and said inner jacket (7) on the one hand and between said stopper (6) and said base-plate (4) on the other hand, the walls (62) and (64) typically exerting a radial compression on the intermediate walls (47), (63), (44) and (74).

Lastly, as shown in FIG. 10, said toothed wheel may include only one skirt (62) engaging with said cylindrical wall (44) of said base-plate (4), so as to form a succession of concentric walls which engage, denoted from inside to outside "62/44".

Whatever the form of dispenser according to the invention, said toothed wheel (6) may include or form a cylindrical outer skirt (64) of diameter equal to 2.R, said diameter being typically at least equal to the width or smaller dimension denoted "1" of said outer tubular wall (80), so as to facilitate the manual rotation of said toothed wheel, by mean particularly of a channelled-out part (87) giving access to said toothed wheel (6). Generally, the toothed wheel extends beyond the vertical alignment of said outer body by an over-thickness equal to (2.R—1)/2, typically from 0.5 to 5 mm.

It is advantageous for the material forming said toothed wheel (6) and the material forming said inner jacket (7) to be selected in such a way that the material forming said inner jacket (7) is indented to a greater degree than that forming said base-plate, so as to provide over time a permanent compression of said vertical wall (74) against said central skirt (63).

Thus, the material forming said inner jacket (7) may be selected from among polyolefins, and typically PE or PP, whereas the material forming said toothed wheel (6) may be selected from SAN, ABS or a mixture of the two, the material forming said outer body (8) being able to be selected typically again from SAN, ABS or a mixture of the two.

According to the invention, and as shown for example in FIG. Bb, said inner jacket; (7) may include an upper skirt (75) intended to engage with said cap (3), typically with the inside of said cap, said cap engaging with said outer body (8) according to a common cross-section, so as to have a continuity of line and appearance, and typically in such a way that said cap (3) is typically in the extension of said outer body (8) and has possibly the same outer cross-section as the latter.

Said cap (3) may include, as shown in FIG. 9*a*, an inner skirt (35) integral with the head of the cap snapping together in a leakproof way with said upper skirt (75), typically by at least one contact area of the torus/cylinder type.

However, as shown particularly in FIGS. 8*a* and 8*b*, said cap (3) may include an inner leakproof lining (31) and an outer shell (30), said inner leakproof lining (31) being anchored to said outer shell (30) by an axial assembly means (34), said leakproof lining (31) engaging with said upper skirt (75) in a typically leakproof way, said leakproof lining (31) including a peripheral groove (312) engaging with an upper edge (750) of said upper skirt (75).

Said outer shell (30) may include an inner shoulder (300) and a lower wall (301), typically opposite said upper skirt (75), said dispenser being closed; said leakproof lining may include a peripheral skirt (314), in such a way that said peripheral skirt (314) is subject to a radial compression between said lower wall (301) and said upper skirt (75), and/or to an axial compression between said shoulder (300) and said upper edge (750).

Said outer shell (30) may typically be of ABS, said inner leakproof lining being typically of PP.

According to the invention, said central part (52) forming a nut and/or said axial screw (42) includes/include radial elasticity means, constituting a capacity for radial deformation under stress, such that, in the event of forced rotation under said stress and of locking of said screams relative to said nut, the "male" and "female" threading is allowed to disengage, to be subject in other words to a relative axial displacement, by overlapping of the threading and clearance of a screw thread, without said engagement between screw and nut being destroyed.

According to the invention, said outer body may have a typically rectangular cross-section with a form factor L/l, L and l being the largest and the smallest dimension respectively, from 2 to 10, and typically from 3 to 6, with L being typically from 30 mm to 100 mm.

Moreover, in the event of a typically high form factor, and in the event of a radius R typically below 10 mm, an additional means (9), typically a tractor, may be anchored to said toothed wheel, typically by means of a notched surface (90) engaging with said toothed wheel with notched outer skirt (64), so as to facilitate the rotation of said small diameter toothed wheel by increasing its manual contact surface and the over-thickness of the toothed wheel relative to the axial alignment of said outer body (8). See FIGS. 11*a* to 11*c*.

EMBODIMENT EXAMPLES

All the figures correspond to embodiment examples. Dispensers (1) or sticks of rectangular cross-section and 75 ml capacity have been manufactured, except in the case of the stick in FIG. 10 which is of round cross-section.

The typical dimensions of these rectangular sticks were:

total height H (stick closed): 111 mm, with an outer body (8) height of 74 mm and a cap (3) height of 36 mm length L (cross-section): 59 mm width l (cross-section): 29 mm The outer body (8) and the cap (3) of the same rectangular cross-section included plane surfaces connected to each other with a radius of curvature R3=0.4 mm.

Some of the surfaces included concave parts of 0.8 mm, suitable particularly for decoration by embossing to 0.7 mm, in such a way that said embossing is not flush with the surface or does not extend beyond said concave part.

Said tubular part (80) of said outer body (8) had a thickness Ec of 1.5 mm (or 0.7 mm where there are concave parts to 0.8 mm), said tubular part (70) of said inner jacket having a thickness Ei of 1 mm.

Dispensers were also manufactured with Ei equal to 1 mm (without concave carts) and Ei equal to 0.5 mm.

In all cases, a material gain from 5 to 10% was noted in relation to sticks of the same capacity.

The radius of the toothed wheel (6) was taken substantially equal to ½.

The different carts constituting these sticks were manufactured by moulding selecting the following plastic materials from the following series:

a) in relation to the body (2):

a1—for the outer body (8): PS, SAN, ABS, PET, PP a2—for the inner jacket (7): PET, PP, PE, POM a3—for the base-plate (4) and the screw (42): PP, POM, PE a4—for the piston (5): PS, PP, SAN, ABS, PS, POM, PE a5—for the toothed wheel (6): SAN, PS, ABS, PET, PP, PC b) in relation to the cap (3):

b1—for the outer shell (30): PS, SAN, ABS, PET, PP, PC b2—for the inner leakproof lining: PE Dispensers (1) were obtained with the materials underlined above.

All the parts were assembled by fitting and snapping on axially.

ADVANTAGES OF THE INVENTION

The invention has many advantages, particularly in the field of aesthetics, a field which in the event is essential insofar as dispensers (1) according to the invention allow the image and shape of dispensers to be renewed without for all that sacrificing the technical performance of these dispensers.

Indeed, these dispensers are used to package body care products or cosmetic products and where the external or visual appearance of the dispenser pack plays an important part in the decision to buy, as is well known.

Thus, on the one hand, the invention makes it possible to manufacture dispensers that are typically parallelepiped in shape, whereas this type was totally excluded in the prior art, and on the other hand, it makes it possible to manufacture dispensers of low capacity, for example 50 to 100 ml, while retaining excellent manual grip.

But the invention also has technical advantages insofar as it makes it possible in particular to manufacture with a higher throughput, and particularly to mould with a higher throughput dispensers (1)—of any shape, even round—according to the invention.

LIST OF REFERENCE NUMBERS

Dispenser . . . 1
- Vertical axis . . . 10
- Cosmetic product . . . 11
- Radial/axial engagement means between 7 and 8 . . . 12
- Snap-on means between 4 and 7 . . . 13
- Leakproof seal means between 6 and 7 . . . 14
- Snap-on means between 7 and 8 . . . 15
- Leakproof seal means between 4 and 7 . . . 16
- Engagement means between 4 and 6 . . . 17

Body . . . 2
- Lateral wall . . . 20
- Central cavity . . . 21
- Upper orifice . . . 22
- Bottom . . . 23
- Lower orifice . . . 24

Cap . . . 3
- Outer shell . . . 30
  - Inner shoulder . . . 300
  - Lower wall . . . 301
- Inner leakproof lining . . . 31
  - Peripheral skirt . . . 310
  - Roof for shaping 11 . . . 311
  - Peripheral groove for 750 . . . 312
  - Shoulder . . . 313
- Snap-on means with 751 . . . 32
- Concave area . . . 33
- Radial and axial engagement means . . . 34
- Inner skirt . . . 35

Base-plate of the propellant device . . . 4
- Hollowed-out part/Channel . . . 40
- Assembly means with 20 . . . 41
- Axial screw . . . 42
- Milled surface engaging with 61 . . . 43
- Cylindrical wall C . . . 44
- Connecting arm between 42 and 44 . . . 45
- Cavity formed by 44 . . . 46
- Central cylindrical wall . . . 47

Piston engaging with 42 . . . 5
- Distributor fin . . . 50
- Channel for 11 to pass through . . . 51
- Central threaded part engaging with 42 . . . 52

Toothed wheel engaging with 4 and sealing 24 or 40 . . . 6
- Milled surface engaging with 43 . . . 61
- Inner skirt J1 . . . 62
- Central skirt J2 . . . 63
- Outer skirt J3 . . . 64
- Notched outer skirt engaging with 90 . . . 65

Inner jacket of 2 . . . 7
- Inner tubular part . . . 70
- Outer roof . . . 71
  - Radial projection to form 12 . . . 710
- Area with high radius of curvature Ri . . . 72
- Bottom . . . 73
  - Vertical projection of 73 . . . 730
- First vertical wall P1 . . . 74
  - Shoulder for 13 . . . 740
- Upper skirt . . . 75
  - Upper edge . . . 750
  - Snap-on means with 32 . . . 751
  - Shoulder . . . 752
- Outer bottom . . . 76

Outer body . . . 8
- Outer tubular part . . . 8C
- Inner roof . . . 81
  - Radial Projection to form 12 . . . 810
- Area with the low radius of curvature Re . . . 82
- Bottom . . . 83
  - Vertical (milled) projection engages with 730 . . . 830
  - Vertical non-milled projection . . . 831

Upper part . . . 84
- Peripheral channelling . . . 840
- Lower part . . . 85
- Concave area . . . 86
- Channelled out part for manual access to 6 . . . 87
- Typically plane surfaces . . . 88

Additional means or tractor/strap . . . 9
- Notched inner surface engaging with 65 . . . 90

What is claimed is:

1. A dispenser (1) of a product (11), typically of a stick-form cosmetic product, including a body (2) forming a lateral wall (20) of a moulded plastic material delimiting a central cavity (21) intended to contain said product, with, at its upper end, an upper orifice (22), and, at its lower end, typically a bottom (23) including a circular lower orifice (24), a cap (3) intended to seal said upper orifice (22), a propellant device including a base-plate (4) and a piston (5), said base-plate (4), typically fitted with a channel or hollowed-out part (40), engaging with said lower orifice (24)

typically by a means of assembly that provides a rotation of said base-plate (4) relative to said lateral wall (20) or said bottom (23), said base-plate (4) including a so-called "male" helical thread axial screw (42), said piston (5) forming a support for said product, typically open-work with a hollowed-out part (51), and a central part (52) with a so-called "female" thread engaging by screwing with said axial screw (42), a toothed wheel (6) of external radius R engaging in rotation with said base-plate (4) to rotate said axial screw (42) manually, and correspondingly move said piston (5), and a means of sealing said lower orifice (24) and/or said hollowed-out part (40), characterised in that said lateral wall (20) includes an assembly:

a) of an inner jacket (7) including an inner tubular part (70), of area cross-section Si and thickness Ec, forming at an upper end said upper orifice (22) and including at a lower end said lower orifice (24), said inner jacket typically delimiting said central cavity (21), b) and an outer body (8) including an outer tubular part of area cross-section Se>Si and thickness Ei, said thicknesses Ec and Ei being taken typically below 2 mm, so as to be able to manufacture said typically rigid dispenser using high throughput moulding and without dimensional distortion of said inner jacket (7) and said outer body (8) of plastic material, and in such a way that, since said inner tubular part is part of or is included in said outer tubular part, and cannot therefore be seen from the side, said outer body is able to have a cross-section different from that of said inner jacket, with in particular different radii of curvature for said outer body and for said inner jacket.

2. The dispenser according to claim 1 wherein said base-plate (4) seals said lower orifice (24), is fitted with at least one hollowed-out part or channel (40), and typically forms a cavity (46) and wherein said toothed wheel (6) forms a typically leakproof plug for said hollowed-out part or channel (40) or said cavity (46), so as to form said sealing means and to allow said dispenser (1) to be filled through the bottom.

3. The dispenser according to claim 1 wherein said inner jacket (7) and said outer body (8) include radial and axial engagement means (12, 15), in such a way that they form a rigid body after a typically axial assembly of said inner jacket into said outer body.

4. The dispenser according to claim 1 wherein said thickness Ei is from 0.3.E to 0.7.E and said thickness Ee is from 0.3.E to 0.7.E.

5. The dispenser according to claim 1 wherein said inner jacket (7) includes areas (72) with a high radius of curvature Ri typically above 30 mm, said outer body (8) including areas (82) with a radius of curvature Re below Ri.

6. The dispenser according to claim 5 wherein said outer body (8) includes typically plane surfaces (88), said surfaces, typically internally tangent to said inner jacket (7), being connected via said areas with a radius of curvature Re (82) typically less than 1 mm.

7. The dispenser according to claim 1 wherein said inner jacket (7) includes an outer roof (71) or a radial projection (710) engaging with said outer tubular part (80) of said outer body (8), to form said radial and/or axial engagement means (12), said inner roof (71) typically having an area corresponding to a cross-section difference ΔS=Se—Si for said upper end.

8. The dispenser according to claim 7 wherein said outer tubular part (80) of said outer body (8) engages at its upper part (84) with said outer roof (71) or with said radial projection (710), so as to form an upper radial and/or axial stop, typically by means of a peripheral channel (840).

9. The dispenser according to claim 8 wherein said toothed wheel (6) has a diameter equal to 2.R at least equal to the width 1 or smaller dimension of the cross-section of said outer tubular part (80), in such a way that said toothed wheel (6) forms an axial stop for said outer tubular part (80).

10. The dispenser according to claim 1 wherein said outer body (8) includes an inner roof (81) engaging with said inner tubular part (70) of said inner jacket (7), to form said radial and/or axial engagement means (12), said inner roof (81) typically having an area corresponding to a cross-section difference ΔS=Se—Si for said upper end.

11. The dispenser according to claim 10, wherein said tubular part (70) of said inner jacket (7) engages at its upper part with said inner roof (81) or with a radial projection (810), so as to form an upper radial and/or axial stop, typically by means of an upper edge (750).

12. The dispenser according to claim 1 wherein said bottom (23) is formed or includes externally a bottom (83) integral with said outer tubular part (80), said bottom (83) engaging typically with said inner jacket (7) to form said axial and/or radial engagement means (12).

13. The dispenser according to claim 12 including said outer roof (71) and/or said radial projection (710) and said bottom (83).

14. The dispenser according to claim 13 wherein said bottom (83) includes typically milled vertical projections (830), formed on its upper surface, engaging, typically by fitting or snapping-on axially, with said bottom (73) by means of vertical projections (730) formed on its inner surface.

15. The dispenser according to claim 14 wherein said vertical projections (730) form an outer milled square engaging with an inner milled square formed by said vertical projections (830).

16. The dispenser according to claim 1 wherein said bottom (23) is formed or includes an outer bottom (76) integral with said inner tubular part (70), said bottom (76) typically engaging with said outer body (8) to form said axial and/or radial engagement means.

17. The dispenser according to claim 16 including an inner roof (81) and/or said radial projection (810) and an outer bottom (76).

18. The dispenser according to claim 17 wherein said outer bottom (76) engages with said outer tubular part (80), at its lower part, by snapping on so as to form said snap-on means (15).

19. The dispenser according to claim 1 wherein said inner (70) and outer (80) tubular parts are tangent, said area cross-section Si falling within said area cross-section Se, in such a way that said inner tubular part (70) has no degree of freedom in the radial direction relative to said outer tubular part (80).

20. The dispenser according to claim 1 wherein said base-plate (4) is fitted to said inner jacket (7), by means either of said inner tubular part (70), or of said bottom (73), or of a vertical wall (74) integral with said bottom (73) or with said inner tubular part (70), typically by snapping-on axially (13) or engagement of male and female components or fitting, said base-plate (4) being typically fitted to said lateral jacket (70) or to said bottom (73) or to said vertical wall (74), typically by inserting said base-plate (4) and said associated piston (5) into said inner jacket (7) through said upper orifice (22).

21. The dispenser according to claim 20 wherein said toothed wheel (6) includes three concentric skirts: an inner skirt (62) typically bearing said milled surface (43), a central skirt (63) typically engaging in a leakproof way with said vertical wall (74), an outer skirt (64) forming a manual rotation button.

22. The dispenser according to claim 21 wherein the engagement of said toothed wheel (6) with said base-plate, said base-plate engaging with said inner jacket (7), forms a succession of concentric walls which engage, denoted from inside to outside "62/44/63/74/64", the walls (62) and (43) ensuring the engagement in rotation of said toothed wheel and of said piston, the walls (63) and (74) providing the leakproof seal between said toothed wheel and said inner jacket, the walls (62) and (74) typically exerting a radial compression on the intermediate walls (44) and (63).

23. The dispenser according to claim 21 wherein the engagement of said toothed wheel (6) with said base-plate, said base-plate engaging with said inner jacket (7), forms a succession of concentric walls which engage, denoted from inside to outside "62/44/74/63/64", the walls (62) and (43) ensuring the engagement in rotation of said toothed wheel and of said piston, the walls (63) and (74) providing the leakproof seal between said toothed wheel and said inner jacket, the walls (62) and (64) typically exerting a radial compression on the intermediate walls (44) and (74).

24. The dispenser according to claim 21 wherein said base-plate (4) includes two cylindrical walls (44) and (47), and wherein the engagement of said toothed wheel (6) with said base-plate, said base-plate engaging with said inner jacket (7), forms a succession of concentric walls which engage, denoted from inside to outside "62/47/63/44/74/64", the walls (62) and (47) typically ensuring the engagement in rotation of said toothed wheel and said piston, the leakproof seal being typically provided between said base-plate (4) and said inner jacket (7) on the one hand and between said plug (6) and said base-plate (4) on the other hand, the walls (62) and (64) typically exerting a radial compression on the intermediate walls (47), (63), (44) and (74).

25. The dispenser according to claim 20 wherein said toothed wheel includes only one skirt (62) engaging with said cylindrical wall (44) of said base-plate (4), so as to form a succession of concentric walls which engage, denoted from inside to outside "62/44".

26. The dispenser according to claim 20 wherein the material forming said toothed wheel (6) and the material forming said inner jacket (7) are selected in such a way that the material forming said inner jacket (7) is indented to a greater degree than that forming said base-plate, so as to provide over time a permanent compression of said vertical wall (74) against said central skirt (63).

27. The dispenser according to claim 26 wherein the material forming said inner jacket (7) is selected from among polyolefins, and typically PE or PP, and wherein the material forming said toothed wheel is selected from SAN, ABS or a mixture of the two, the material forming said outer body being selected typically again from SAN, ABS or a mixture of the two.

28. The dispenser according to claim 1 wherein said base-plate (4) includes a typically cylindrical wall (44, 47) engaging in rotation with said toothed wheel (6) or with a skirt (62, 63, 64) of said toothed wheel, typically by snapping on or fitting in such a way as to form a radial and axial engagement means (17).

29. The dispenser according to claim 28 wherein the axial engagement between said toothed wheel (6) and said base-plate (4) is formed by snapping on or fitting two typically cylindrical milled coaxial surfaces (61) and (43), which enmesh, or possibly by firmly fitting said toothed wheel (6) or said skirt (62, 63, 64) into said base-plate (4) or into said cylindrical wall (44, 47).

30. The dispenser according to claim 28 wherein said toothed wheel, typically by means of said central skirt (63), engages in a leakproof way with said inner tubular part (70), or with said bottom (73), or with said vertical wall (74), to form said leakproof seal means (14) in a way so as to render optional, or possibly to eliminate, the leakproof seal of said means of assembly of said base-plate (4) to said inner jacket (70), or to said bottom (73) or to said vertical wall (74).

31. The dispenser according to claim 28 wherein said toothed wheel (6) engages in a leakproof way with said base-plate (4), and possibly with said inner tubular part (70), or with said bottom (73), or with said vertical wall (74), said base-plate possibly engaging in a leakproof way with said inner tubular part (70), or with said bottom (73), or with said vertical wall (74).

32. The dispenser according to claim 1 wherein said toothed wheel includes a cylindrical outer skirt (64) of diameter equal to 2.R, said diameter being typically at least equal to the width or smaller dimension denoted "1" of said outer tubular wall (80), so as to facilitate the manual rotation of said toothed wheel, by means particularly of a channelled-out part (87) giving access to said toothed wheel (6).

33. The dispenser according to claim 1 wherein said inner jacket (7) includes an upper skirt (75) intended to engage with said cap (3), said cap engaging with said outer body (8) according to a common cross-section, so as to have a continuity of line and appearance, and typically in such a way that said cap (3) is typically in the extension of said outer body (8) and has possibly the same outer cross-section as the latter.

34. The dispenser according to claim 33 wherein said cap (3) includes an inner leakproof lining (31) and an outer shell (30), said inner leakproof lining (31) being anchored to said outer shell (30) by an axial assembly means (34), said leakproof lining (31) engaging with said upper skirt (75) in a typically leakproof way, said leakproof lining (31) including a peripheral groove (312) engaging with an upper edge (750) of said upper skirt (75).

35. The dispenser according to claim 34 wherein said outer shell (30) includes an inner shoulder (300) and a lower wall (301), typically opposite said upper skirt (75), said dispenser being closed, and wherein said leakproof lining includes a peripheral skirt (314), in such a way that said peripheral skirt (314) is subject to a radial compression between said lower wall (301) and said upper skirt (75), and/or to an axial compression between said shoulder (300) and said upper edge (750).

36. The dispenser according to claim 34 wherein said outer shell is typically of ABS, said inner leakproof lining being typically of PP.

37. The dispenser according to claim 1 ant one of claims 1 to 3G wherein said central part (52) forming a nut and/or said axial screw (42) include radial elasticity means, (constituting a capacity for radial deformation under stress, such that, in the event of forced rotation under said stress and of locking of said screw relative to said nut, the "male" and "female" threading is allowed to disengage, to be subject in other words to a relative axial displacement, by overlapping of the threading and clearance of a screw thread, without said engagement between screw and nut being destroyed.

38. The dispenser according to claim 1 wherein said outer body (8) has a typically rectangular cross-section with a form factor L/l, L and l being the largest and the smallest dimension respectively, from 2 to 10, and typically from 3 to 6, with L being typically from 30 mm to 100 mm.

39. The dispenser according to claim 38 wherein, in the event of a typically high form factor, and in the event of a radius R typically below 10 mm, an additional means (9) typically a tractor, is anchored to said toothed wheel, typically by means of a notched surface (90) engaging with said toothed wheel with notched outer skirt (64), so as to facilitate the rotation of said small diameter toothed wheel by increasing its manual contact surface.

* * * * *